US010655896B2

(12) United States Patent
Qazi et al.

(10) Patent No.: US 10,655,896 B2
(45) Date of Patent: May 19, 2020

(54) TEMPERATURE STABILIZING ENCLOSURE

(71) Applicant: InvenSense, Inc., San Jose, CA (US)

(72) Inventors: Muhammad Maaz Qazi, Morgan Hill, CA (US); Brian H. Kim, Fremont, CA (US); Haijun She, San Jose, CA (US)

(73) Assignee: InvenSense, Inc., San Jose, CA (US)

( * ) Notice: Subject to any disclaimer, the term of this patent is extended or adjusted under 35 U.S.C. 154(b) by 448 days.

(21) Appl. No.: 15/380,835

(22) Filed: Dec. 15, 2016

(65) Prior Publication Data

US 2017/0176062 A1 Jun. 22, 2017

Related U.S. Application Data

(60) Provisional application No. 62/270,490, filed on Dec. 21, 2015.

(51) Int. Cl.
*F25B 21/04* (2006.01)
*F25B 49/00* (2006.01)

(52) U.S. Cl.
CPC ..... *F25B 21/04* (2013.01); *F25B 49/00* (2013.01); *F25B 2321/0212* (2013.01)

(58) Field of Classification Search
CPC ..... F25B 21/02–04; F25B 2321/023; H01L 23/051; H05K 1/0201–0212
See application file for complete search history.

(56) References Cited

U.S. PATENT DOCUMENTS

2002/0131159 A1* 9/2002 Ye ..... H01S 3/06758 359/337.2
2013/0264610 A1* 10/2013 Chen ..... B81C 1/0023 257/252

FOREIGN PATENT DOCUMENTS

DE 102013223023 A1 * 5/2015 ..... H01L 23/3677

OTHER PUBLICATIONS

English translation of DE-102013223023-A1 provided by Espacenet. (Year: 2013).*

* cited by examiner

*Primary Examiner* — Tareq Alosh

(57) ABSTRACT

A device includes a substrate, a micro-electro-mechanical system (MEMS) device disposed on the substrate, a controller disposed on the substrate, a heating element, and an enclosure. The heating element is configured to generate heat in response to a signal generated by the controller. The enclosure encloses the MEMS sensor device, the controller, and the heating element. The controller is configured to generate the signal responsive to temperature measurements within the enclosure. The signal causes the heating element to generate heat and maintain a predetermined temperature within the enclosure.

8 Claims, 10 Drawing Sheets

TEMPERATURE STABILIZING ENCLOSURE

RELATED APPLICATIONS

This application claims the benefit and priority to the U.S. Provisional Patent Application No. 62/270,490, filed on Dec. 21, 2015, entitled "Heating Enclosure with Stabilized Temperature," which is incorporated herein by reference in its entirety.

BACKGROUND

Many electronic devices use sensors for measuring various information, e.g., speed, motion, etc. However, the profile of the sensor changes in response to changes in temperature, resulting in inaccuracies. The inaccuracies resulting from changes in temperature are more pronounced in applications where wide temperature swings exist such as drone technology.

SUMMARY

Accordingly, a need has arisen to control sensor profile as temperature changes. For example, a need has arisen to maintain a predetermined temperature within the enclosure that houses the sensor in order to maintain the sensor profile as temperature external to the enclosure varies. It is appreciated that in some embodiment the predetermined temperature may be user programmable.

In some embodiments, a device may include a substrate, a micro-electro-mechanical system (MEMS) device disposed on the substrate, a controller disposed on the substrate, a heating element, and an enclosure. The heating element, e.g., a resistor, a thermoelectric material having peltier effect (also known as peltier device), etc., is configured to generate heat in response to a signal generated by the controller. The enclosure encloses the MEMS sensor device, the controller, and the heating element. The controller is configured to generate the signal responsive to temperature measurements within the enclosure. The signal causes the heating element to generate heat and maintain a predetermined temperature, e.g., greater than 45° C., within the enclosure. As a result, the MEMS sensor device, e.g., a gyroscope sensor, a motion sensor, an accelerometer sensor, and a pressure sensor, maintains the same profile. In some embodiments, predetermined temperature is user programmable. The predetermined temperature may be automatically adjusted based on temperature outside of the enclosure. In some embodiments, the predetermined temperature is greater than the temperature outside of the enclosure.

In some embodiments, the substrate forms one side of the enclosure. The enclosure further includes another substrate forming another side of the enclosure and a mid-enclosure connecting to the substrate, e.g., a printed circuit board (PCB), and to the another substrate, e.g., a PCB, to enclose the MEMS sensor device, the controller, and the heating element within the enclosure. The mid-enclosure may include a plurality of vias for electrically coupling the substrate to the another substrate.

In some embodiments, the heating element may be disposed on the substrate and/or the another substrate. It is appreciated that according to some embodiments, more than one heating element may be used and disposed in various locations, e.g., the substrate and the another substrate.

In some embodiments, a device may include a substrate, a micro-electro-mechanical system (MEMS) device, e.g., a gyroscope sensor, a motion sensor, an accelerometer sensor, and a pressure sensor, etc., disposed on the substrate, a controller disposed on the substrate, a thermoelectric element, e.g., peltier device, and an enclosure that encloses the MEMS sensor device, the controller, and the thermoelectric element. The thermoelectric element is configured to heat up or cool in response to a signal generated by the controller. The controller is configured to generate the signal responsive to temperature measurements within the enclosure. The signal causes the thermoelectric element to heat up if a temperature measurement within the enclosure is below a predetermined temperature and the signal causes the thermoelectric element to cool if the temperature measurement within the enclosure is above the predetermined temperature to maintain temperature within the enclosure at the predetermined temperature. In some embodiments, predetermined temperature is user programmable.

It is appreciated that the substrate may form one side of the enclosure and the enclosure may further include another substrate forming another side of the enclosure and a mid-enclosure connecting to the substrate and to the another substrate to enclose the MEMS sensor device, the controller, and the thermoelectric element within the enclosure. It is appreciated that the mid-enclosure may include a plurality of vias for electrically coupling the substrate to the another substrate.

It is appreciated that the substrate and/or the another substrate may include a PCB. In some embodiments, the thermoelectric element may be disposed on the substrate and/or the another substrate.

These and other features and aspects of the concepts described herein may be better understood with reference to the following drawings, description, and appended claims.

DETAILED DESCRIPTION

Before various embodiments are described in greater detail, it should be understood by persons having ordinary skill in the art that the embodiments are not limiting, as elements in such embodiments may vary. It should likewise be understood that a particular embodiment described and/or illustrated herein has elements which may be readily separated from the particular embodiment and optionally combined with any of several other embodiments or substituted for elements in any of several other embodiments described herein.

It should also be understood by persons having ordinary skill in the art that the terminology used herein is for the purpose of describing the certain concepts, and the terminology is not intended to be limiting. Unless indicated otherwise, ordinal numbers (e.g., first, second, third, etc.) are used to distinguish or identify different elements or steps in a group of elements or steps, and do not supply a serial or numerical limitation on the elements or steps of the embodiments thereof. For example, "first," "second," and "third" elements or steps need not necessarily appear in that order, and the embodiments thereof need not necessarily be limited to three elements or steps. It should also be understood that, unless indicated otherwise, any labels such as "left," "right," "front," "back," "top," "middle," "bottom," "forward," "reverse," "clockwise," "counter clockwise," "up," "down," or other similar terms such as "upper," "lower," "above," "below," "vertical," "horizontal," "proximal," "distal," and the like are used for convenience and are not intended to imply, for example, any particular fixed location, orientation, or direction. Instead, such labels are used to reflect, for example, relative location, orientation, or directions. It should also be understood that the singular forms of "a," "an," and "the" include plural references unless the context clearly dictates otherwise.

Unless defined otherwise, all technical and scientific terms used herein have the same meaning as commonly understood by persons of ordinary skill in the art to which the embodiments pertain.

Many electronic devices use sensors for measuring various information, e.g., speed, motion, etc. However, the profile of the sensor changes in response to changes in temperature, resulting in inaccuracies. Accordingly, a need has arisen to control the sensor profile as temperature changes. For example, a need has arisen to maintain a predetermined temperature within the enclosure that houses the sensor in order to maintain the sensor profile as temperature external to the enclosure varies. It is appreciated that in some embodiments the predetermined temperature may be user programmable.

Figure 1A:
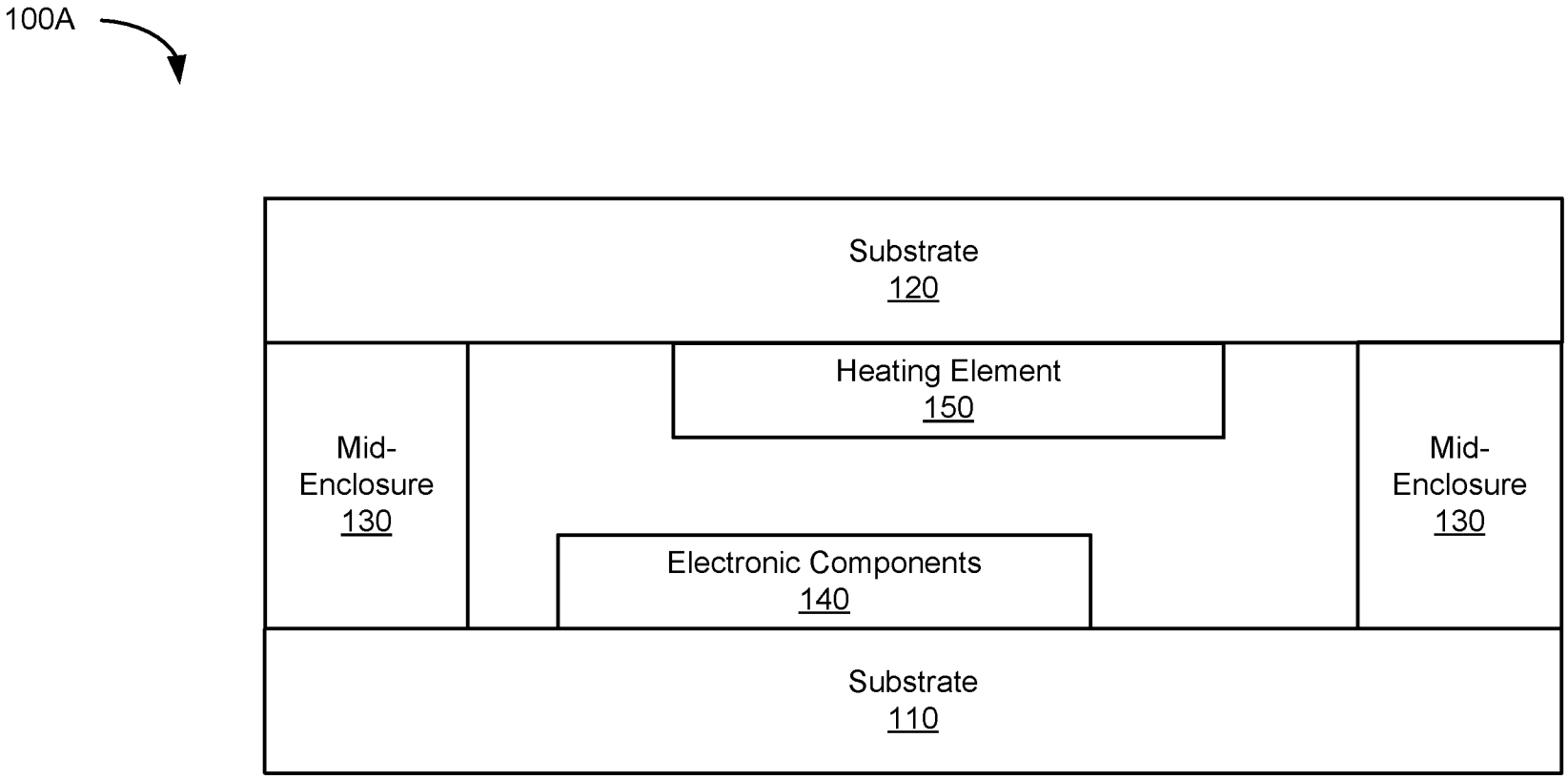
FIGS. 1A-1C show a system with controlled sensor profile in accordance with some embodiments.
Figure 1B:
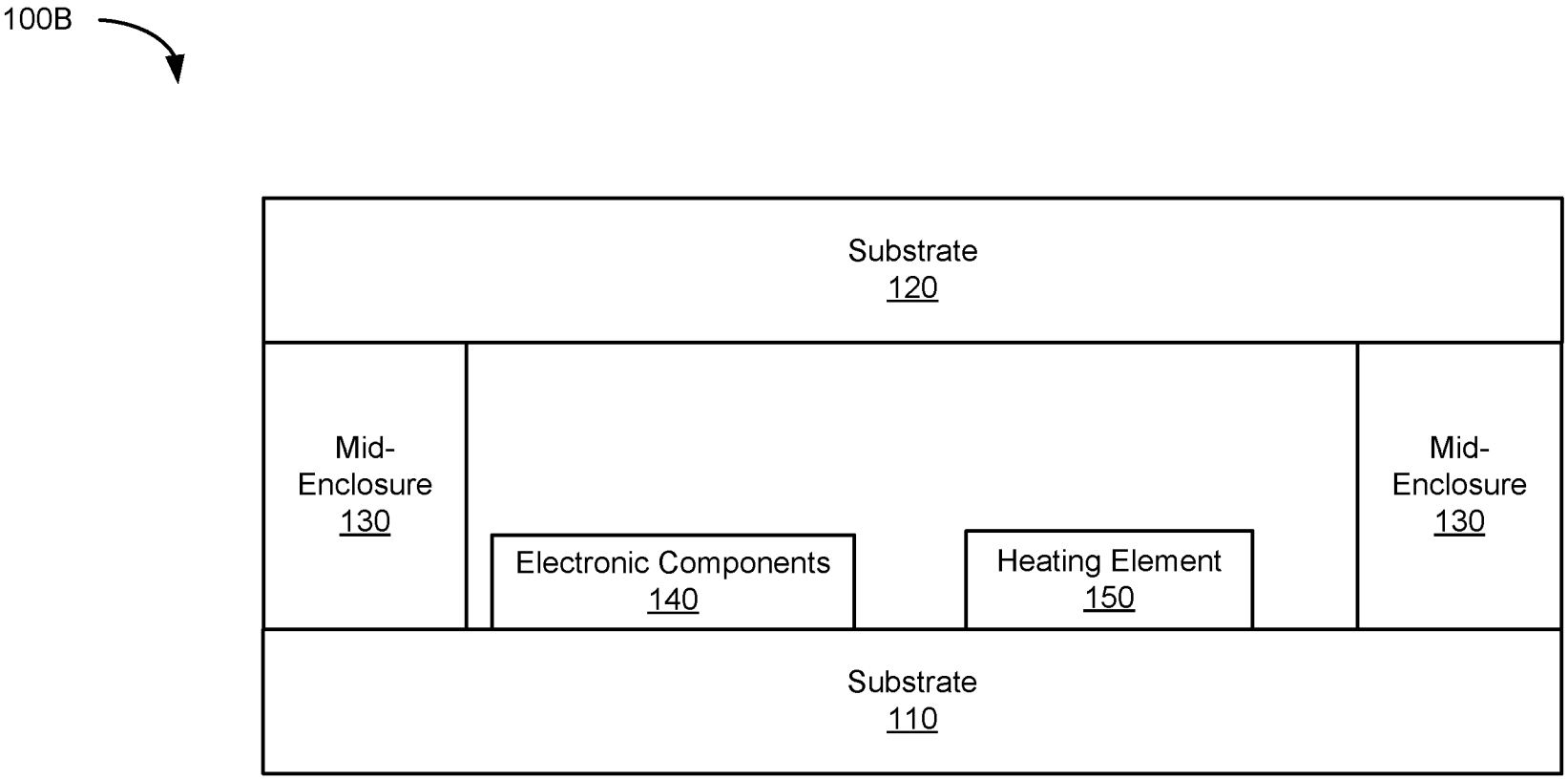
Figure 1C:
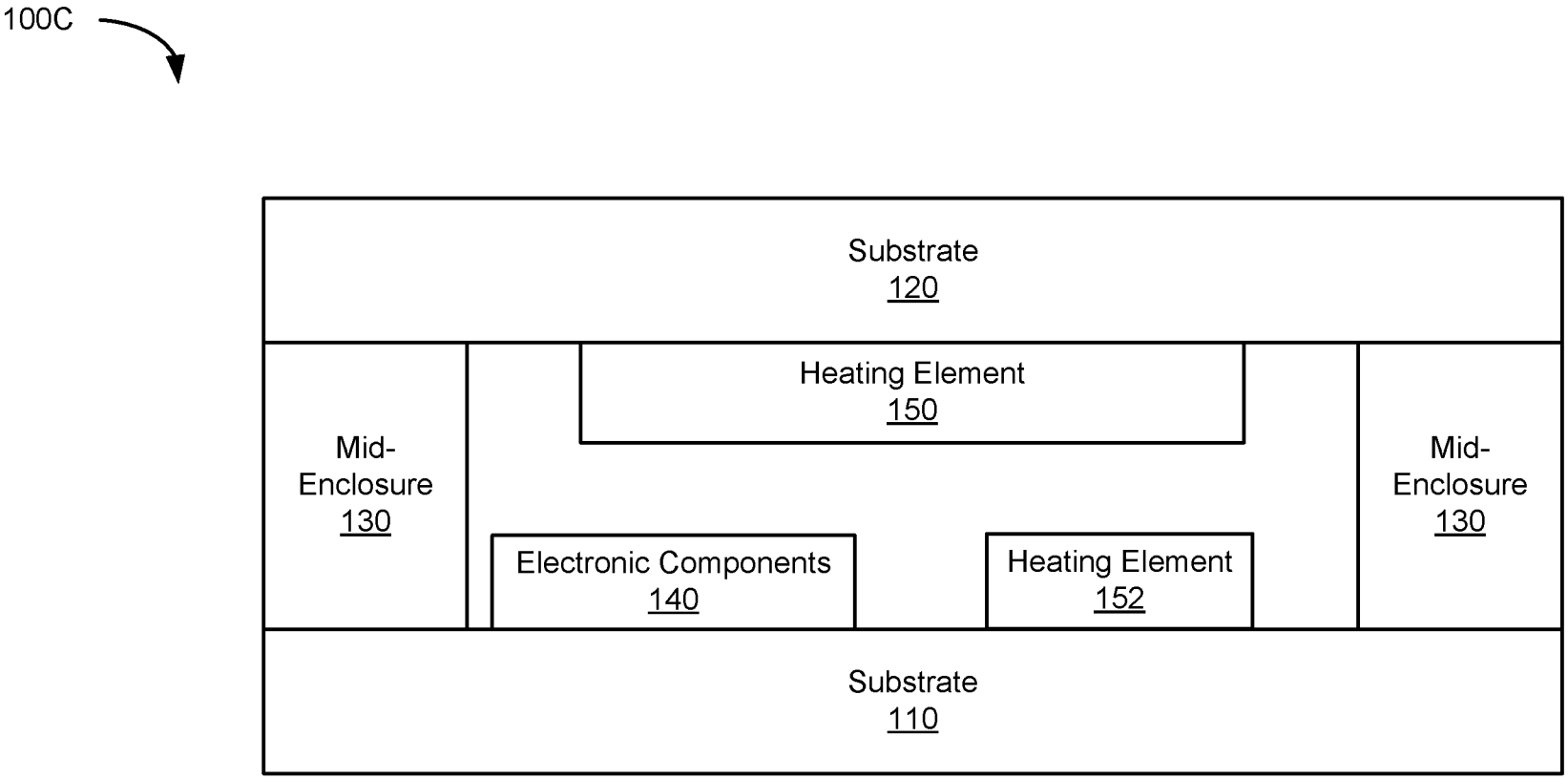

Referring now to FIGS. 1A-1C, a system with controlled sensor profile in accordance with some embodiments is shown. More specifically referring to FIG. 1A, a device 100A includes substrates 110 and 120, a mid-enclosure 130, electronic components 140, and a heating element 150. In order to maintain a substantially constant profile for one or more electronic components, e.g., sensor profile, the temperature within the enclosure is controlled. For example, the temperature within the enclosure may be kept substantially constant at a predetermined temperature, which may be user programmable. The heating element 150 may include a resistor with a particular resistance value that heats up as current flows through it. It is appreciated that the amount of heat generated may be controlled based on the value of selected resistance. It is further appreciated that other types of heating elements may be used, e.g., thermoelectric element, etc.

It is appreciated that the electronic components 140 may be disposed on the substrate 110 and the heating element 150 may be disposed on the substrate 120. In some embodiments, the electronic components 140 may include a micro-electro-mechanical system (MEMS) device, e.g., a gyroscope sensor, a motion sensor, an accelerometer sensor, and a pressure sensor, etc., and a controller as well as other electronic components, e.g., temperature sensor. It is appreciated that the MEMS sensor device may be a sensor to measure motion, acceleration, pressure, rotation, etc. The controller may be a processor, e.g., central processing unit, application specific integrated circuit, a field programmable gate array, etc.

According to some embodiments, the substrates 110-120, and the mid-enclosure 130 enclose the electronic components 140 and the heating element 150 within. In other words, the substrates 110-120 and the mid-enclosure 130 separate the electronic components 140 and the heating element 150 from the external environment. It is appreciated that the substrates 110-120 may include a printed circuit board (PCB), plastic, metal, or any combination thereof. Furthermore, it is appreciated that in some embodiments a top enclosure (not shown) connected to the substrate 120, to mount the substrate 120, and a bottom enclosure (not shown) connected to the substrate 110, to mount the substrate 110, may be used that are each connected to the mid-enclosure 130 in order to form the enclosure and to enclose the electronic components 140 and the heating element 150 rather than using the substrates 110 and 120 as the top and bottom enclosures. The top and the bottom enclosure may include insulating material such as plastic compounds. In some embodiments, the mid-enclosure 130 may include insulating material such as plastic components. It is appreciated that the mid-enclosure 130 connects to the substrates 110 and 120 to enclose the electronic components 140 and the heating element 150. It is further appreciated that even though the mid-enclosure 130 is shown as a separate piece from the substrates 110 and 120 or the top and bottom enclosures (not shown) that the substrates 110-120 mount on, they may be formed as a single integrated piece.

According to some embodiments, a temperature sensor may measure the temperature within the enclosure. If the measured temperature is below the predetermined temperature, e.g., 45° C., the controller may generate a signal to cause the heating element 150 to generate heat. For example, a signal generated by the controller may cause a current to flow through the heating element 150 that may be a resistor in order to generate heat proportional to its resistance value.

It is appreciated that the predetermined temperature may be user programmable and selectable, e.g., 5° C., 10° C., 11° C., 14° C., 27° C., 32° C., 39° C., 45° C., 48° C., 53° C., 57° C., 61° C., 65° C., 73° C., etc. Moreover, it is appreciated that selection of a higher temperature, e.g., 45° C., maintains a substantially constant sensor profile because most locations are cooler than 45° C. In some embodiments, the predetermined temperature of 55° C. may be selected. As such, the environment within the enclosure maintains a constant temperature and therefore a substantially constant sensor profile is maintained.

Referring now to FIG. 1B, a different configuration of a system with controlled sensor profile is shown in accordance with some embodiments. In this embodiment, the device 100B and the heating element 150 may be disposed on the substrate 110 as opposed to the substrate 120 in FIG. 1A. Referring now to FIG. 1C, a system with controlled sensor profile is shown in accordance with some embodiments where more than one heating element is used. The system 100C is similar to that of FIG. 1A and it may further include an additional heating element 152 that is disposed on the substrate 110. It is appreciated that the heating element 152 may operate similar to that of heating element 150. It is appreciated that the heating elements 150 and 152 may both be disposed on the same substrate, e.g., substrate 110, or substrate 120, etc. and illustration of the heating elements 150-152 on different substrates is for illustrative purposes and not intended to limit the scope of the embodiments.

Figure 2A:
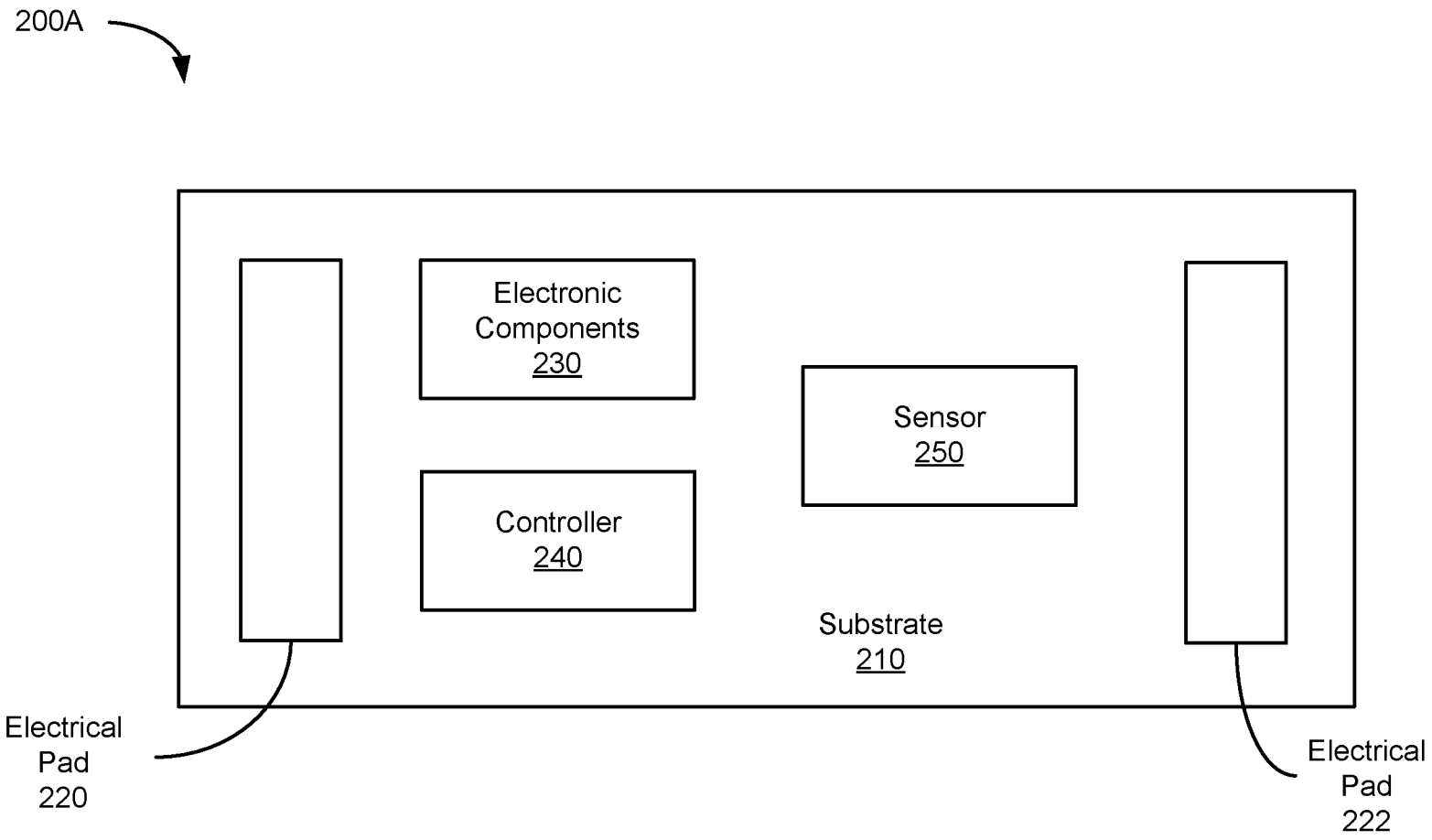
FIGS. 2A-2D show a top and side view of a system for controlling sensor profile in accordance with some embodiments.

Referring now to FIGS. 2A-2D, a top and side view of a system for controlling sensor profile in accordance with some embodiments is shown. FIG. 2A depicts a top view of a bottom portion of the device in accordance with some embodiments. System 200A may include a substrate 210 that is similar to substrate 110. Electronic components 230, a controller 240, and a sensor 250 may be disposed on the substrate 210. The substrate 210 may also include electrical pads 220-222 for making electrical connection to substrate 270 through the mid-enclosure 260 (shown in FIGS. 2B and 2C).

The electronic components 230 may include components such as a temperature sensor and other electronic components. The temperature sensor, for example, may measure temperature within the enclosure. The controller 240 may be a processor, e.g., central processing unit, application specific integrated circuit, a field programmable gate array, etc., for processing data, e.g., whether to generate a signal for a heating element 280 (shown in FIGS. 2C and 2D) to maintain a temperature at a predetermined temperature within the enclosure, etc. The sensor 250 may be a MEMS sensor device, e.g., a gyroscope sensor, a motion sensor, an accelerometer sensor, and a pressure sensor, etc., to measure motion, acceleration, pressure, rotation, etc. The electrical pads 220-222 make electrical connections between the components on the substrate 210 and other components, e.g., heating element 280 disposed on substrate 270 (discussed in FIGS. 2C and 2D), etc. For example, the electrical pads 220-222 may be used to electrically couple the controller 240 to the heating element 280 such that a signal generated by the controller 240 in response to the measured temperature within the enclosure falling below a predetermined temperature is transmitted to the heating element 280 in order to cause the heating element 280 to generate heat. As such, temperature within the enclosure is maintained at the predetermined temperature, thereby maintaining sensor 250 profile regardless of temperature variations external to the enclosure.

Figure 2B:
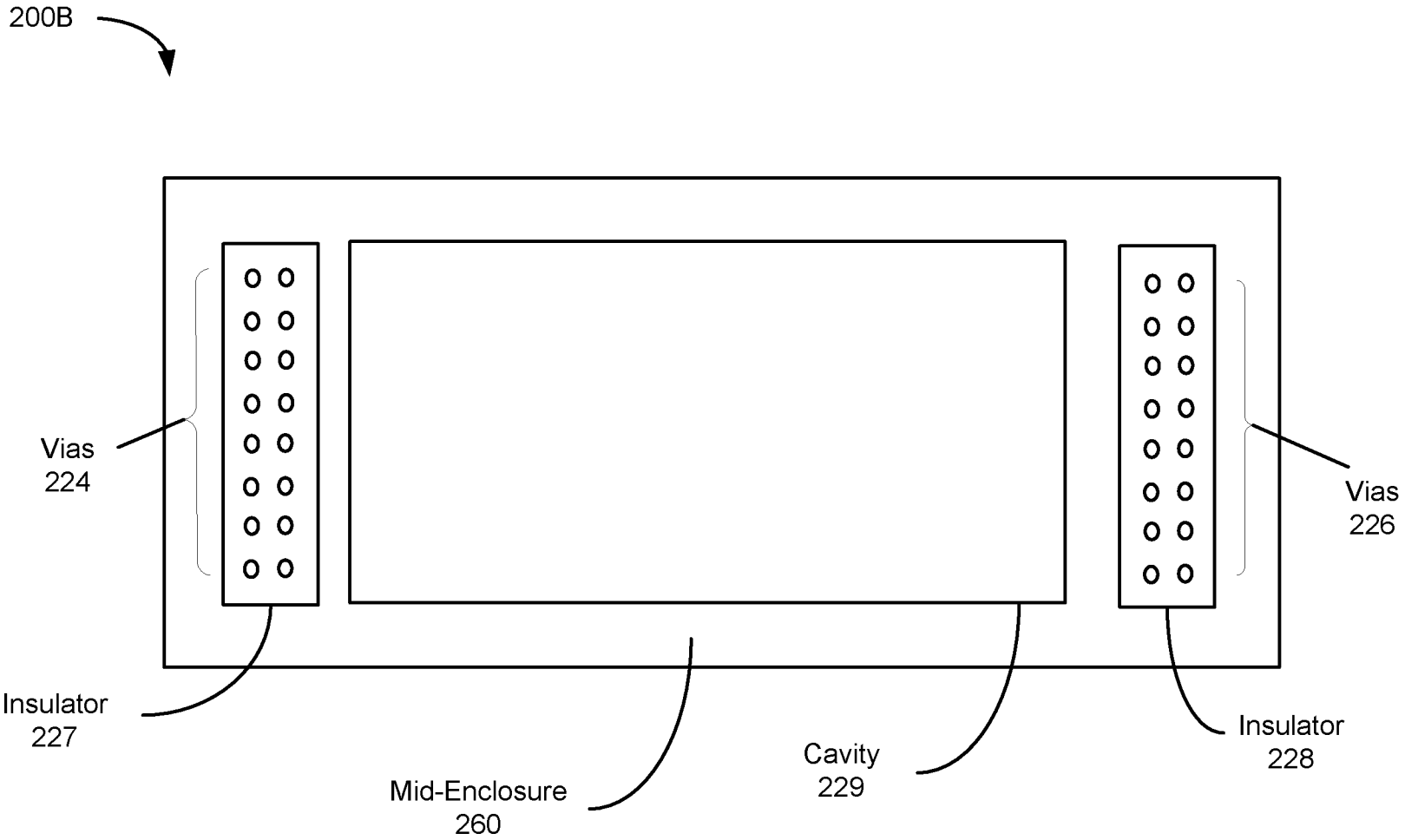

Referring now to FIG. 2B, a top view of the mid-enclosure 260 according to some embodiments is shown. The mid-enclosure 260 may be similar to the mid-enclosure 130 described above. In some embodiments, the mid-enclosure 260 may include insulators 227-228 and vias 224 and 226. The insulators 227-228 electrically insulate the signals being transmitted through vias 224 and 226. The vias 224 and 226 receive a signal generated by the controller 240 and transmit it to the heating element 280. It is appreciated that in some embodiments, the vias 224 and 226 may also transmit power to the heating element 280. For example, in response to the signal being generated by the controller 240 that the heating element 280 is to generate heat, the vias 224 and 226 may receive electric current from a power source, e.g., battery, etc., and transmit the received current to the heating element 280 that heats up in response to the current flowing through the heating element 280. It is appreciated that the middle portion of the mid-enclosure 260 may include a cavity or a hole 229 in order to accommodate the electronic components 230, controller 240, and sensor 250 from one end while accommodating the heating element 280 or any other electronic components disposed on the substrate 270 (see FIGS. 2C and 2D) from the other end.

Figure 2C:
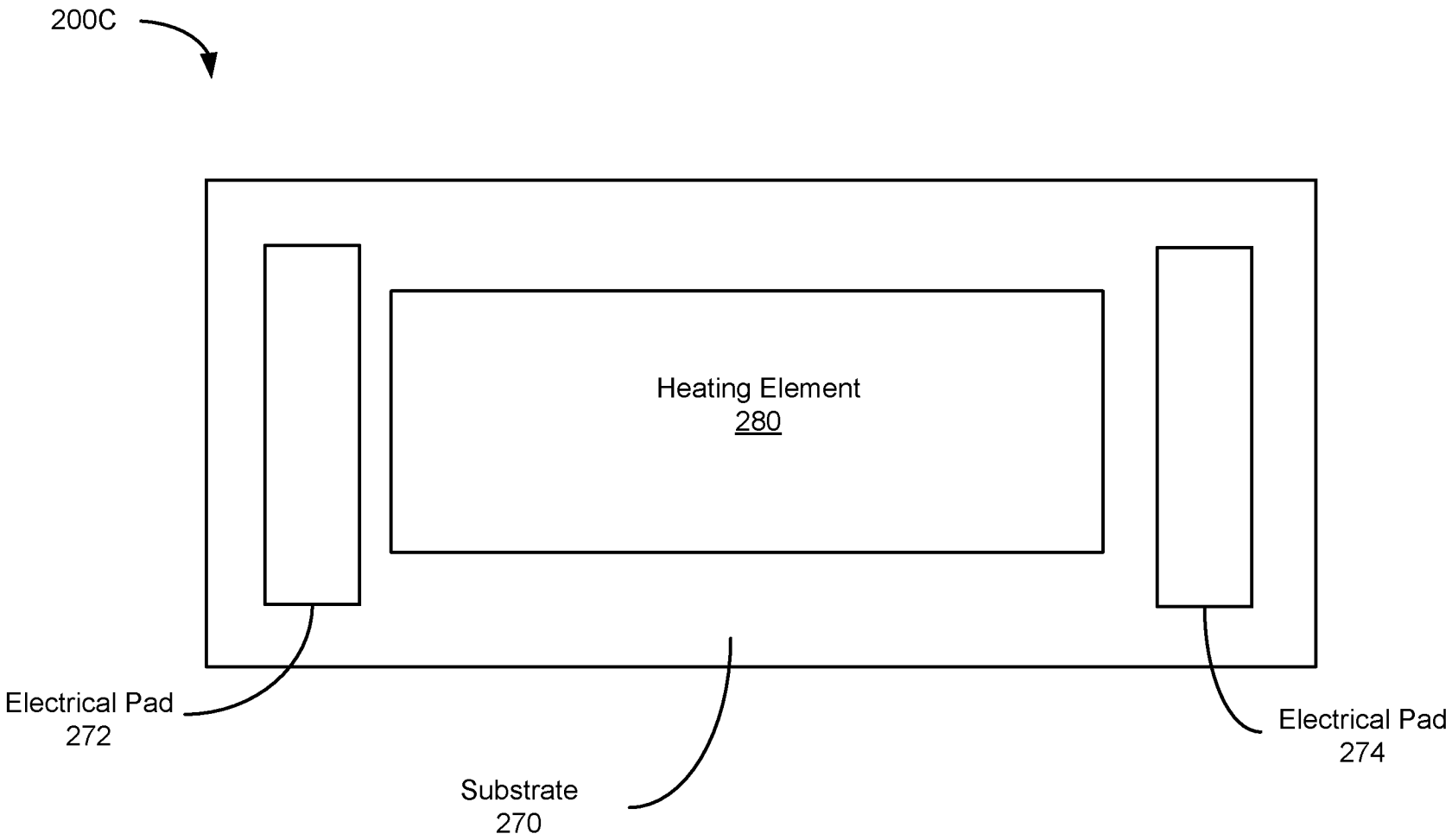

Referring now to FIG. 2C, a top view of the top substrate or enclosure in accordance with some embodiments is shown. The substrate 270 may be similar to substrate 120 and the heating element 150. The substrate 270 may include electrical pads 272 and 274 in order to enable electrical connection between the substrate 210 and substrate 270 through the vias 224 and 226.

Figure 2D:
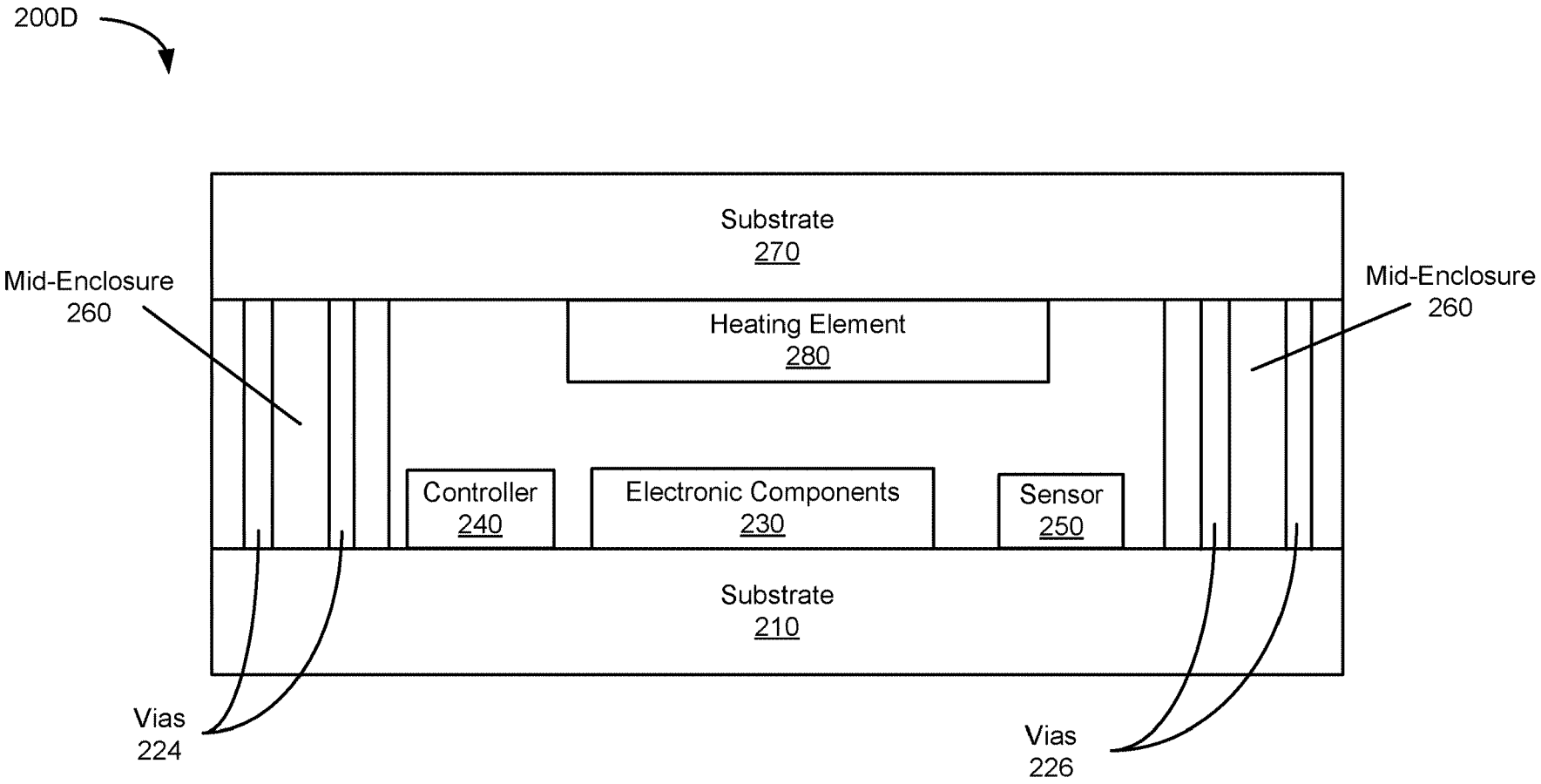

Referring now to FIG. 2D, a side view of the device 200D in accordance with some embodiments is shown. The side view of the device 200D illustrates assembly of the components in order to form a sealed enclosure.

Figure 3:
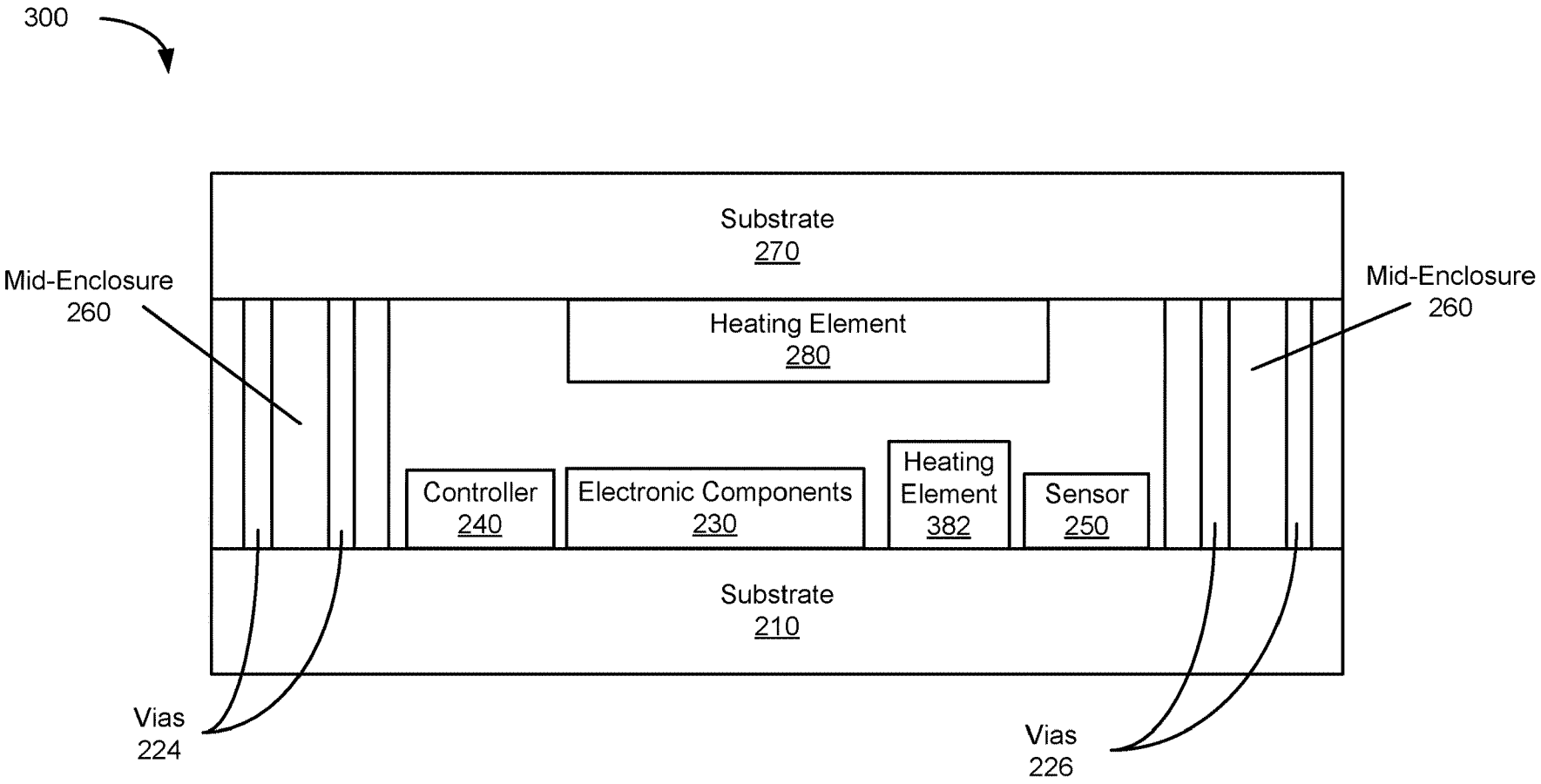
FIG. 3 shows another system for controlling sensor profile in accordance with some embodiments.

Referring now to FIG. 3, another system 300 for controlling sensor profile in accordance with some embodiments is shown. System 300 is substantially similar to that of device 200D. However, system 300 includes more than one heating element. In this embodiment, another heating element 382 is disposed on the substrate 210. However, it is appreciated that the heating element 382 may be disposed on the substrate 270 or even on a substrate elsewhere, e.g., a substrate mounted on the mid-enclosure 260 for instance. The heating element 382 is similar to the heating element 150 described above.

Figure 4:
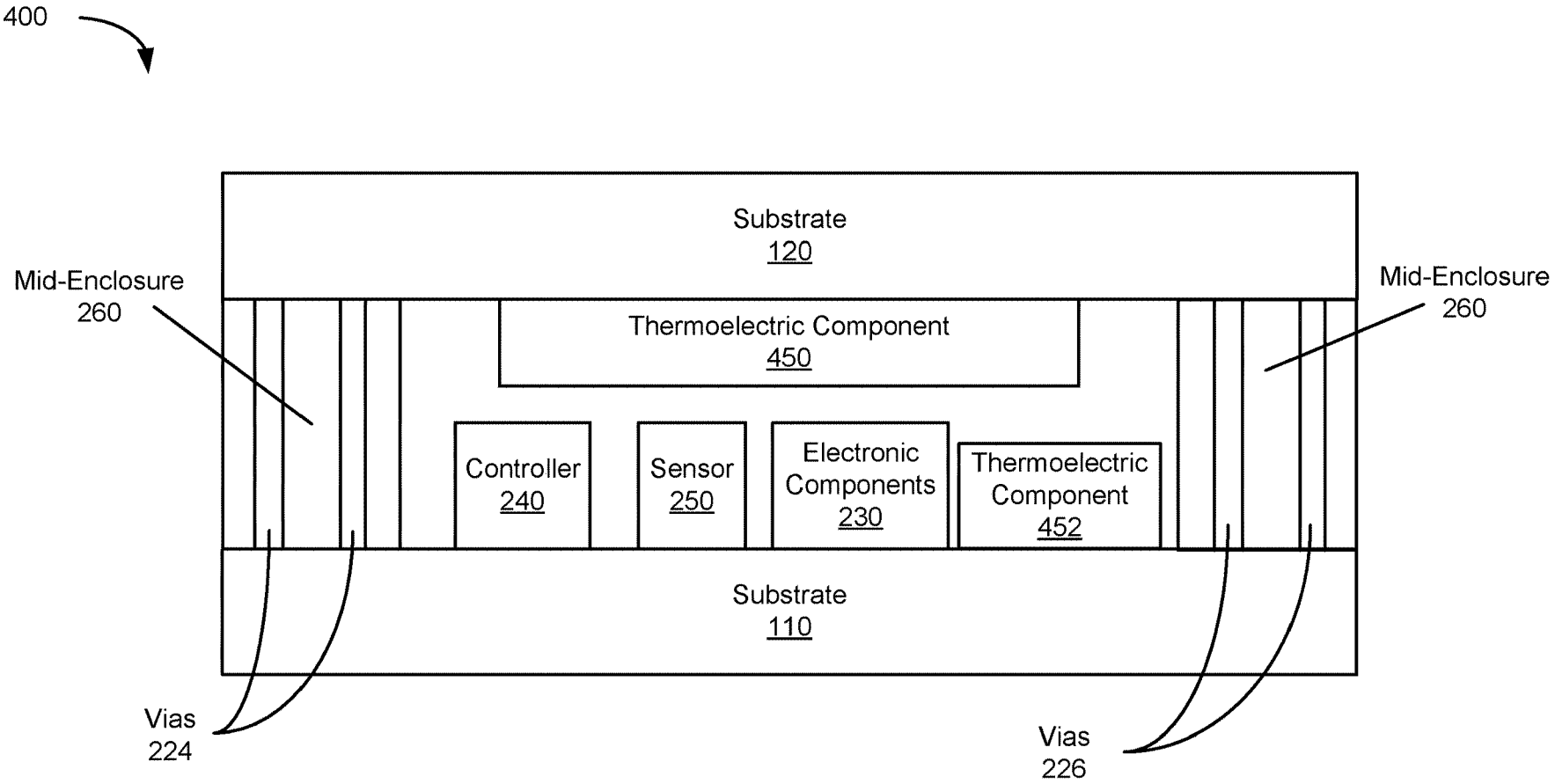
FIG. 4 shows a system for controlling a sensor profile by cooling and heating the internal space within an enclosure in accordance with some embodiments.

Referring now to FIG. 4, a system 400 for controlling a sensor profile by cooling and heating the internal space within an enclosure in accordance with some embodiments is shown. System 400 is substantially similar to that of system 300. However, in system 400 thermoelectric components 450 and 452 are used instead of the heating elements 280 and 382. Thermoelectric components 450 and 452 may generate heat as well being able to actively cool in response to electric current's direction flowing through them. Characteristics of the thermoelectric components 450 and 452 to generate heat or to cool responsive to direction of current is also known as the perltier effect. Accordingly, the temperature within the enclosure may be kept at the predetermined temperature, thereby maintaining the sensor 250 profile regardless of the temperature external to the enclosure.

For example, in one embodiment the controller 240 generates a signal to cause either or both of the thermoelectric components 450 and 452 to generate heat if a sensor (not shown but part of electronic components 230) detects that the internal temperature of the enclosure has fallen below the predetermined threshold. In contrast, the controller 240 generates a signal to cause either or both of the thermoelectric components 450 and 452 to cool if a sensor (not shown but part of electronic components 230) detects that the internal temperature of the enclosure is above the predetermined temperature. As such, the temperature within the enclosure is maintained at the predetermined temperature, thereby maintaining the sensor 250 profile independent of temperature variations external to the enclosure. Moreover, use of the thermoelectric components 450 and 452 enables a lower temperature, e.g., 10° C., 20° C., etc., within the enclosure to be maintained to maintain the sensor 250 profile the same while reducing power consumption required to generate heat or cool by maintaining an internal temperature that is close to the external temperature of the enclosure.

It is appreciated that any number of temperature sensors, MEMS sensors, controllers, thermoelectric components, and/or heating elements may be used. Moreover, it is appreciated that each element, e.g., thermoelectric component or heating element, may be controlled independently by one or more controllers and temperature sensors. As such, description of the embodiments with respect to specific number of elements and components is illustrative and should not be construed as limiting the scope of the embodiments.

It is appreciated that thermoelectric material may include Bismuth Chalcogenides and their nanostructures, e.g., $Bi_2Te_3$, $Bi_2Se_3$, etc., Lead Telluride, e.g., PbTe, $PbTe_{1-x}Se_x$, etc., inorganic clathrates, Magnesium group IV compounds, e.g., $Mg_2Si$, $Mg_2Ge$, $Mg_2Sn$, etc., Silicides, Skutterudite thermoelectrics formed from $(Co, Ni, Fe)(P, Sb, As)_3$, Oxide thermoelectrics, e.g., $(SrTiO_3)_n(SrO)_m$, half Heusler alloys, Silicon-Germanium, Sodium Cobaltate, e.g., $Na_{0.8}CoO_2$, amourphous material, nanomaterials and superlattices, PbTe/Pb SeTe quantum dot superlattice, graphene, etc.

Figure 5:
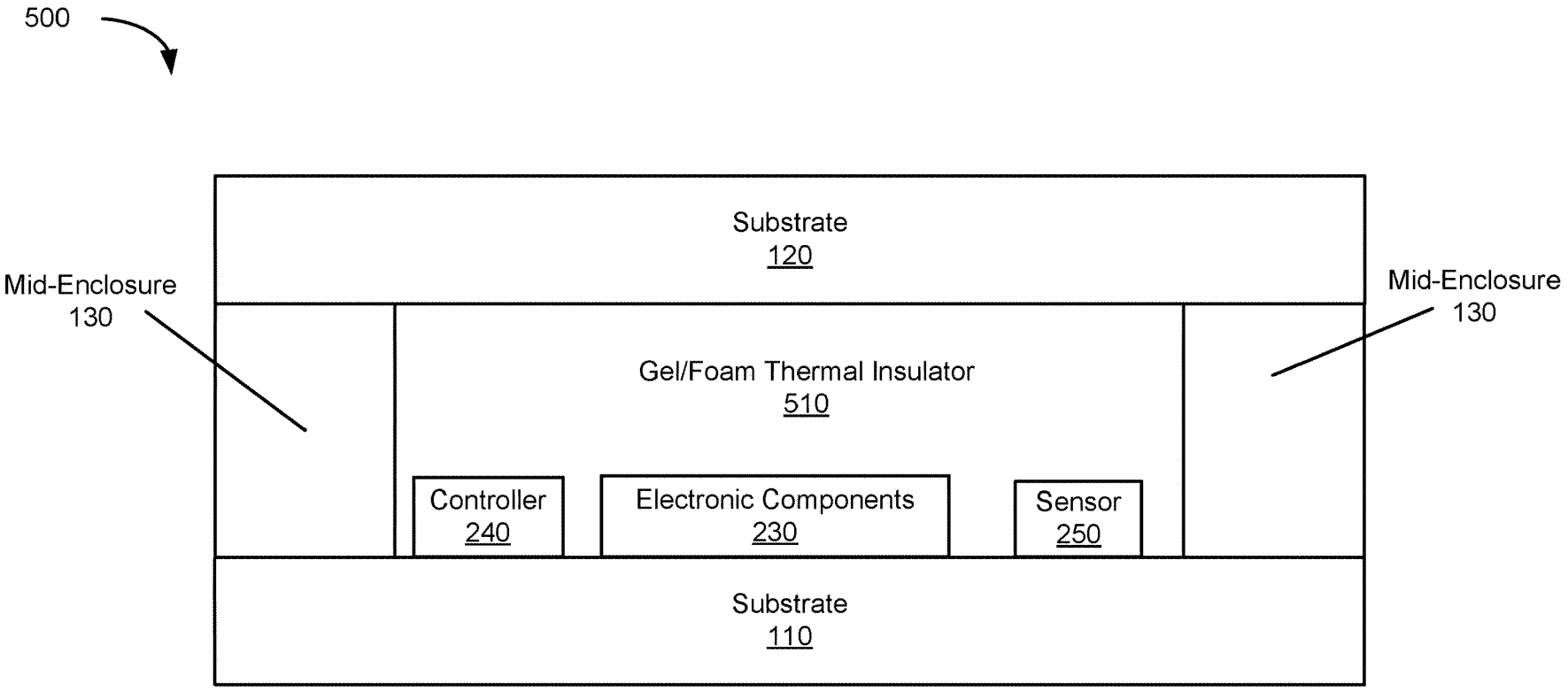
FIG. 5 shows a system for maintaining a substantially constant sensor profile by thermally insulating internal space within an enclosure in accordance with some embodiments.

Referring now to FIG. 5, a system 500 for maintaining a substantially constant sensor profile by thermally insulating internal space within an enclosure in accordance with some embodiments is shown. System 500 is similar to that of FIGS. 1A-C, however, in system 500 instead of using a heating element, the temperature within the enclosure is maintained at the predetermined temperature by using a gel/foam thermal insulator 510. It is appreciated that electronic components 230 that may include a temperature sensor, the controller 240, and the sensor 250 may be disposed on the substrate 110. The mid-enclosure 130 and the substrate 120 (or a top cover enclosure) may seal the controller 240, the electronic components 230 and the sensor 250. The space in between the substrates 110, 120, the mid-enclosure 130, the electronic components 230, the controller 240, and the sensor 250 may be filled with the gel/foam thermal insulator 510 that insulates the internal enclosure from being affected by variation of the external temperature to the enclosure. The gel/foam may be Aerogel based on Alumina, Chromia, Tin Dioxide, metal oxide, e.g., Silica, Titania, Zirconia, Iron Oxide, Vanadia, Neodymium Oxide, Samarium Oxide, Holmium Oxide, Erbium Oxide, etc., and carbon based Aerogel. Accordingly, temperature within the enclosure is maintained at the predetermined temperature, thereby maintaining sensor 250 profile independent of temperature variations outside of the enclosure.

It is appreciated that the description of the embodiments separate from one another is for illustration purposes only and should not be construed as limiting the embodiments. It is further appreciated that while various embodiments with respect to the heating elements, thermoelectric components, and a gel/foam thermal insulators are described, the embodiments should not be construed as limited thereto. For example, a combination of the heating element, thermoelectric component, and gel/foam thermal insulators may be used.

While the embodiments have been described and/or illustrated by means of particular examples, and while these embodiments and/or examples have been described in considerable detail, it is not the intention of the Applicants to restrict or in any way limit the scope of the embodiments to such detail. Additional adaptations and/or modifications of the embodiments may readily appear to persons having ordinary skill in the art to which the embodiments pertain, and, in its broader aspects, the embodiments may encompass these adaptations and/or modifications. Accordingly, departures may be made from the foregoing embodiments and/or examples without departing from the scope of the concepts described herein. The implementations described above and other implementations are within the scope of the following claims.

What is claimed is:

1. A device comprising:

a substrate;

a micro-electro-mechanical system (MEMS) sensor device disposed on the substrate;

a controller disposed on the substrate;

a thermoelectric element configured to generate heat or cool in response to a signal generated by the controller; and an enclosure that encloses the MEMS sensor device, the controller, and the thermoelectric element, wherein the enclosure includes:

a bottom enclosure wherein the substrate is disposed thereon;

a top enclosure wherein another substrate is disposed thereon forming another side of the enclosure opposite to the bottom enclosure; and a mid-enclosure connecting the top enclosure to the bottom enclosure to enclose the MEMS sensor device, the controller, and the thermoelectric element within the enclosure, wherein the top enclosure, the bottom enclosure, and the mid-enclosure comprise insulating material, and wherein the enclosure is configured to form a sealed enclosure, wherein the controller is configured to generate the signal responsive to temperature measurements within the enclosure, and wherein the signal causes the thermoelectric element to generate heat if a temperature measurement within the enclosure is below a predetermined temperature and wherein the signal causes the thermoelectric element to cool if the temperature measurement within the enclosure is above the predetermined temperature to maintain temperature within the enclosure at the predetermined temperature.

2. The device as described by claim 1, wherein the substrate and the another substrate comprise a printed circuit board (PCB).

3. The device as described by claim 2, wherein the thermoelectric element is disposed on the another substrate.

4. The device as described by claim 2, wherein the mid-enclosure comprises a plurality of vias for electrically coupling the substrate to the another substrate.

5. The device as described by claim 1, wherein the MEMS sensor device is selected from a group consisting of a gyroscope sensor, a motion sensor, an accelerometer sensor, and a pressure sensor.

6. The device as described by claim 1, wherein the thermoelectric element is position on the substrate.

7. The device as described by claim 1, wherein the predetermined temperature is user programmable.

8. The device as described by claim 1, wherein the thermoelectric element is a peltier device.

* * * * *